US006213593B1

(12) United States Patent
Sanada

(10) Patent No.: US 6,213,593 B1
(45) Date of Patent: Apr. 10, 2001

(54) IMAGE-FORMING APPARATUS

(75) Inventor: Kazuo Sanada, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 08/770,815

(22) Filed: Dec. 20, 1996

(30) Foreign Application Priority Data

Dec. 21, 1995 (JP) ..... 7-333456

(51) Int. Cl.[7] ..... B41J 2/045
(52) U.S. Cl. ..... 347/68; 347/95
(58) Field of Search ..... 347/95; 396/575, 396/627; 427/466, 421

(56) References Cited

U.S. PATENT DOCUMENTS 4,546,361 * 10/1985 Brescia et al. ..... 347/41
4,688,938 * 8/1987 Demoulin et al. ..... 356/154
4,800,275 * 1/1989 Shimizu et al. ..... 250/317.1
4,873,134 * 10/1989 Fulton et al. ..... 428/156
4,999,646 * 3/1991 Trask ..... 347/44
5,179,405 * 1/1993 Osada et al. ..... 354/324
5,320,250 * 6/1994 La et al. ..... 222/1
5,361,084 * 11/1994 Paton et al. ..... 347/15
5,574,530 * 11/1996 Sanada ..... 347/85
5,583,550 * 12/1996 Hickman et al. ..... 347/41
5,635,969 * 6/1997 Allen ..... 347/96
5,689,751 * 11/1997 Ueda ..... 396/626

* cited by examiner

*Primary Examiner*—John Barlow
*Assistant Examiner*—Michael S Brooke
(74) *Attorney, Agent, or Firm*—Sughrue, Mion, Zinn, Macpeak & Seas, PLLC

(57) ABSTRACT

An image-forming apparatus includes an application device for applying an image-forming solvent to an image-recording material. The application device has a plurality of nozzle holes for ejecting and applying the image-forming solvent to the image-recording material. The application device applies the image-forming solvent to the image-recording material such that sets of three drops of the image-forming solvent, which are ejected from the plurality of nozzle holes and applied onto the image-recording material, are applied onto the image-recording material so as to contact each other without any spaces therebetween. Accordingly, a uniform film (coat) of the image-forming solvent can be formed on the image-recording material.

21 Claims, 13 Drawing Sheets

IMAGE-FORMING APPARATUS

BACKGROUND OF THE INVENTION

1. Field of the Invention

The present invention relates to an image-forming apparatus capable of forming an image by applying an image-forming solvent appropriately on an image-recording material such as a light-sensitive material or an image-receiving material.

2. Description of the Related Art

Image-forming apparatuses, which record images by using two types of image-recording materials such as a light-sensitive material and an image-receiving material, are known.

The image-forming apparatus of this type includes therein an image-forming solvent application section having a tank for storing an image-forming solvent to be applied to a light-sensitive material, and a thermal development-transfer section including a heating drum and a pair of endless pressure belts adapted to rotate with the heating drum in pressure-contact with the outer periphery of the heating drum.

The light-sensitive material, on which an image has been exposed while the material is held and conveyed through the image-forming apparatus, is immersed in the water stored in the image-forming solvent tank of the image-forming solvent application section. After being coated with water in this way, the light-sensitive material is sent into the thermal development-transfer section. The image-receiving material is also sent into the thermal development-transfer section in a manner similar to the light-sensitive material.

In the thermal development-transfer section, the light-sensitive material coated with water is superposed with the image-receiving material, and the superposed light-sensitive material and image-receiving material are wound in close contact on the outer periphery of the heating drum. Further, the two materials are held and conveyed between the heating drum and an endless pressure belt. The light-sensitive material thus is thermally developed, while at the same time, the image is transferred to the image-receiving material so as to form (record) a predetermined image on the image-receiving material.

After the light-sensitive material is immersed in and coated with the water which is provided as an image-forming solvent in the tank, the water that has contacted the light-sensitive material still remains in the tank. As a result, bacteria propagate in the tank by using the slight amount of organic materials, which has eluted from the light-sensitive material, as a source of nutrition. Consequently, the water is liable to be contaminated, which may deteriorate both the image-forming apparatus and the image quality.

A possible solution to this drawback is to keep the water supplying elements such as the tank out of contact with the light-sensitive material and to eject and apply water drops to the light-sensitive material from the water supply. The mere ejection of water drops, however, causes uneven application of atomized water to the light-sensitive material, with the result that the portions of the water drops contacting each other coalesce whereas there are portions of the light-sensitive material to which water is not applied, so that it is difficult to achieve uniform application.

SUMMARY OF THE INVENTION

In view of the aforementioned, an object of the present invention is to provide an image-forming apparatus capable of forming a uniform coat (film) of a solvent on an image-forming material.

According to one aspect of the present invention, there is provided an image-forming apparatus having an application device for applying an image-forming solvent onto an image-recording material, wherein the application device includes a plurality of nozzle holes for ejecting and applying the image-forming solvent onto the image-recording material, and the application device applies the image-forming solvent such that sets of three drops of the image-forming solvent, which are ejected from the plurality of nozzle holes and applied onto the image-recording material adjacent to one another, are applied onto the image-recording material so as to contact each other without any spaces therebetween.

The image-forming apparatus according to this aspect has the following effects.

The application device includes a plurality of nozzle holes for ejecting and applying the image-forming solvent to the image-recording material. Each set of three drops of the image-forming solvent, which are ejected from the nozzle holes and applied to the image-recording material adjacent to one another, are applied onto the image-recording material so as to contact each other without any spaces therebetween.

In this way, the image-forming solvent can be ejected from the nozzle holes of the application device and drops of the image-forming solvent can adhere to the image-recording material uniformly and without any spaces therebetween. Therefore, a uniform coat (film) of solvent can be formed on the image-recording material even by an application device which does not contact the image-recording material.

According to another aspect of the present invention, there is provided an image-forming apparatus having an application device for applying an image-forming solvent onto an image-recording material, wherein the application device includes a plurality of nozzle holes for ejecting and applying the image-forming solvent onto the image-recording material, the diameter D of each drop of the image-forming solvent adhering to the image-recording material is expressed as $$D = 2 \cdot \sin\theta \left[ \frac{3 \cdot V}{\pi \cdot \{2 - 3 \cdot \cos\theta + (\cos\theta)^3\}} \right]^{1/3} \quad (1)$$

where V is the volume of a drop of the image-forming solvent ejected from a nozzle hole and θ is the contact angle at which a drop of the image-forming solvent adheres to the image-recording material, and the pitch P between adjacent nozzle holes of the application device is less than or equal to $(\sqrt{3})\cdot D/2$.

The image-forming apparatus according to this aspect has the following effects.

The application device includes a plurality of nozzle holes for ejecting and applying the image-forming solvent to the image-recording material, and the pitch P between adjacent nozzle holes is set to less that or equal to $(\sqrt{3})\cdot D/2$.

The diameter D of each drop of the image-forming solvent attached to the image-recording material is obtained from the above equation (1).

Water drops can be made to uniformly adhere to the image-recording material without any spaces therebetween on the basis of the relation between the pitch P between adjacent nozzle holes and the diameter D of each drop of the image-forming solvent. In the same way as in the previously-described aspect of the invention, therefore, it is possible to form a uniform film (coat) of solvent on the image-recording material even by an application device which does not contact the image-recording material.

DETAILED DESCRIPTION OF THE PREFERRED EMBODIMENTS

Figure 1:
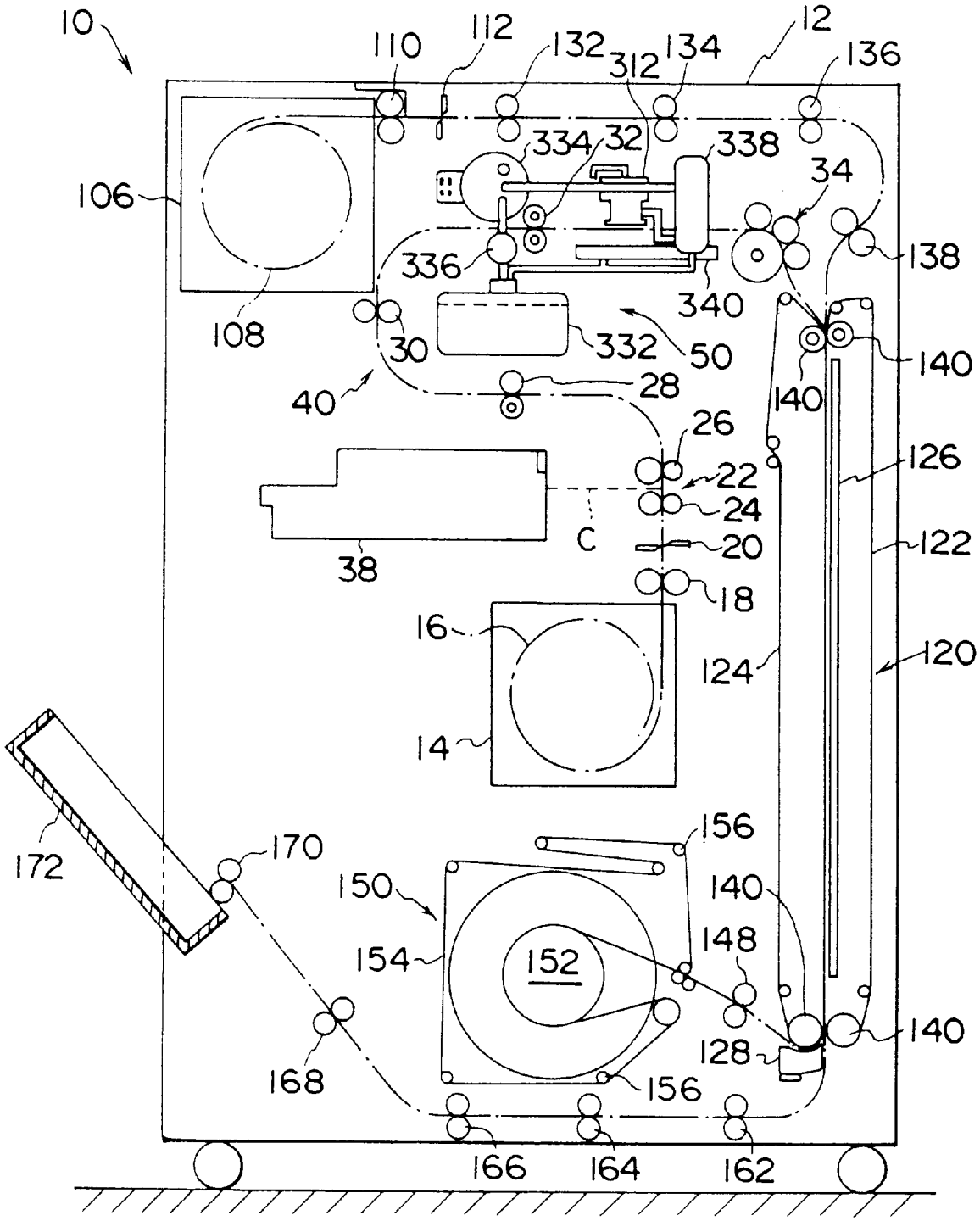
FIG. 1 is a schematic structural view of an image-recording device according to a first embodiment of the present invention.

FIG. 1 is a schematic structural view of an image-recording apparatus 10 which is an image-forming apparatus according to a first embodiment of the present invention.

A light-sensitive material magazine 14 for accommodating a light-sensitive material 16 is disposed in a housing 12 of the image-recording apparatus 10 shown in FIG. 1. The light-sensitive material 16 is taken up in a roll form in the light-sensitive material magazine 14 such that the light-sensitive (exposure) surface of the light-sensitive material 16 is directed to the left when the light-sensitive material 16 is withdrawn from the light-sensitive material magazine 14.

A pair of nip rollers 18 and a cutter 20 are disposed in the vicinity of the light-sensitive material withdrawal opening of the light-sensitive material magazine 14. The light-sensitive material 16 that has been withdrawn from the light-sensitive material magazine 14 by a predetermined length can be cut by this cutter 20. The cutter 20 is a rotary type cutter including a fixed blade and a movable blade, for example, and can cut the light-sensitive material 16 with the movable blade moved vertically by a rotating cam or the like to mesh with the fixed blade.

A plurality of conveying rollers 24, 26, 28, 30, 32, 34 are arranged in that order downstream of the cutter 20 in the direction in which the light-sensitive material 16 is conveyed. A guide plate (not shown) is interposed between each pair of the conveying rollers. The light-sensitive material 16 cut to a predetermined length is conveyed first to an exposure section 22 disposed between the conveying rollers 24, 26.

An exposure unit 38 is disposed at the left of the exposure section 22. The exposure unit 38 includes three types of LDs (laser diodes), a lens unit, a polygonal mirror and a mirror unit (none of which are shown). A light beam C is emitted from the exposure unit 38 to the exposure section 22 to expose the light-sensitive material 16.

Further, a U-turn section 40 for conveying the light-sensitive material 16 along a U-shaped curved path and a water application section 50 for applying an image-forming solvent are disposed above the exposure section 22. In the present embodiment, water is used as the image-forming solvent.

The light-sensitive material 16 that has been conveyed upward from the light-sensitive material magazine 14 and exposed in the exposure section 22 is conveyed while being held between the conveying rollers 28, 30, and thus is sent into the water application section 50 along the upper portion of the U-turn section 40 of the conveying path.

Figure 2:
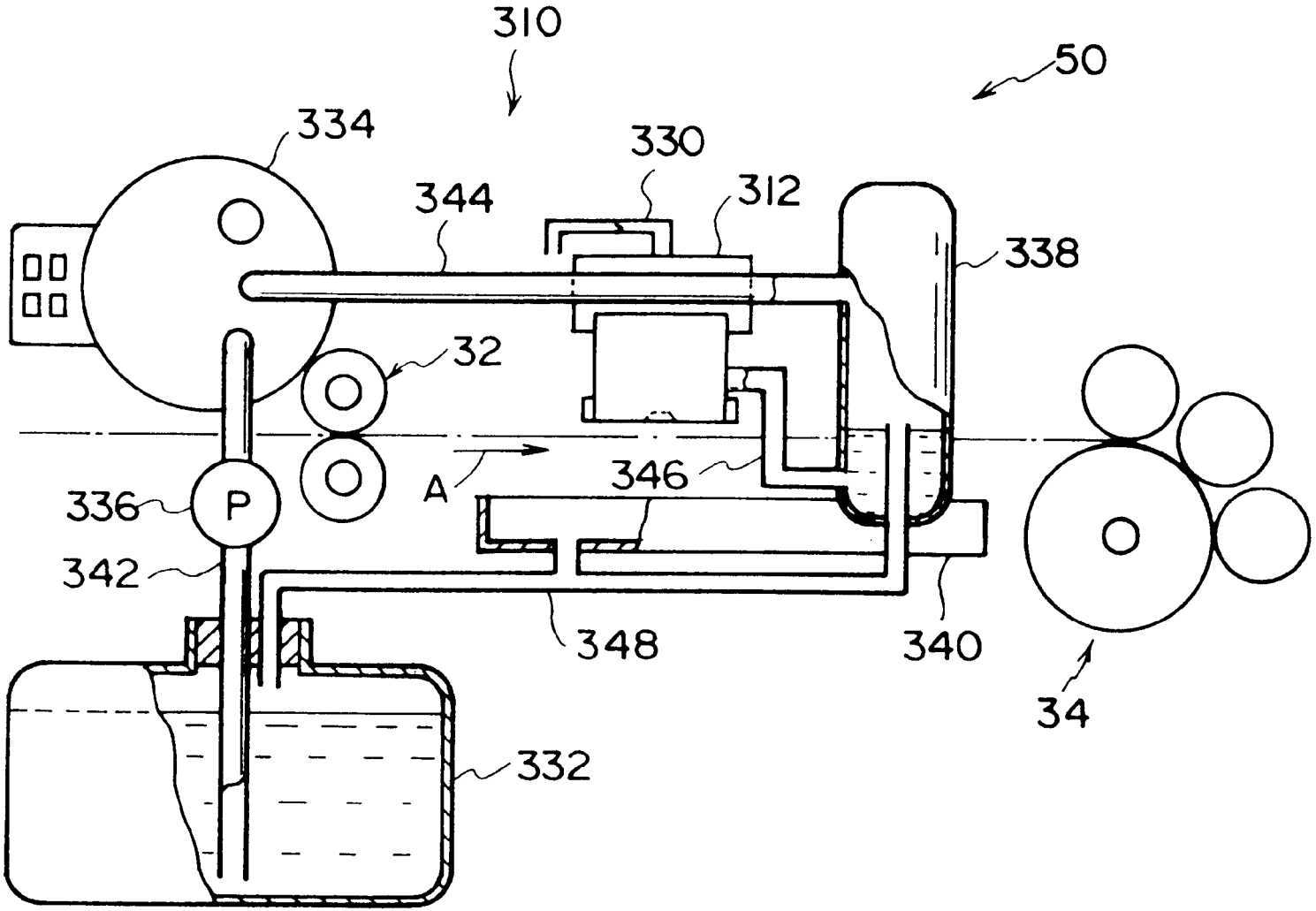
FIG. 2 is a schematic structural view of an application device according to the first embodiment of the invention.

As shown in FIG. 2, an ejection tank 312, which is a portion of a solvent application device 310 is disposed at the portion of the water application section 50 which opposes the conveying path A of the light-sensitive material 16.

As shown in FIG. 2, a water bottle 332 for storing water to be supplied to the ejection tank 312 is disposed at the lower left of the ejection tank 312. A water filter 334 is disposed above the water bottle 332. The water bottle 332 and the filter 334 are connected by a water pipe 342 along which a pump 336 is disposed.

Further, a subtank 338 for storing water supplied from the water bottle 332 is disposed at the right of the ejection tank 312. A water pipe 344 extends from the filter 334 to the subtank 338.

When the pump 336 is activated, water is sent from the water bottle 332 to the filter 334, and the water filtered through the filter 334 is supplied to the subtank 338 where it is stored temporarily.

A water pipe 346 for connecting the subtank 338 and the ejection tank 312 is arranged between the ejection tank 312 and the subtank 338. The water sent by the pump 336 from the water bottle 332 through the filter 334, the subtank 338, and the water pipe 346 is filled into the ejection tank 312.

A tray 340 connected to the water bottle 332 by a circulation pipe 348 is disposed under the ejection tank 312. The water which overflows from the ejection tank 312 is collected in the tray 340 and returned through the circulation pipe 348 to the water bottle 332. Further, the circulation pipe 348 extends so as to project into the subtank 338, and is connected to the subtank 338. The excess water stored in the subtank 338 is returned to the water bottle 332 through the circulation pipe 348.

Figure 4:
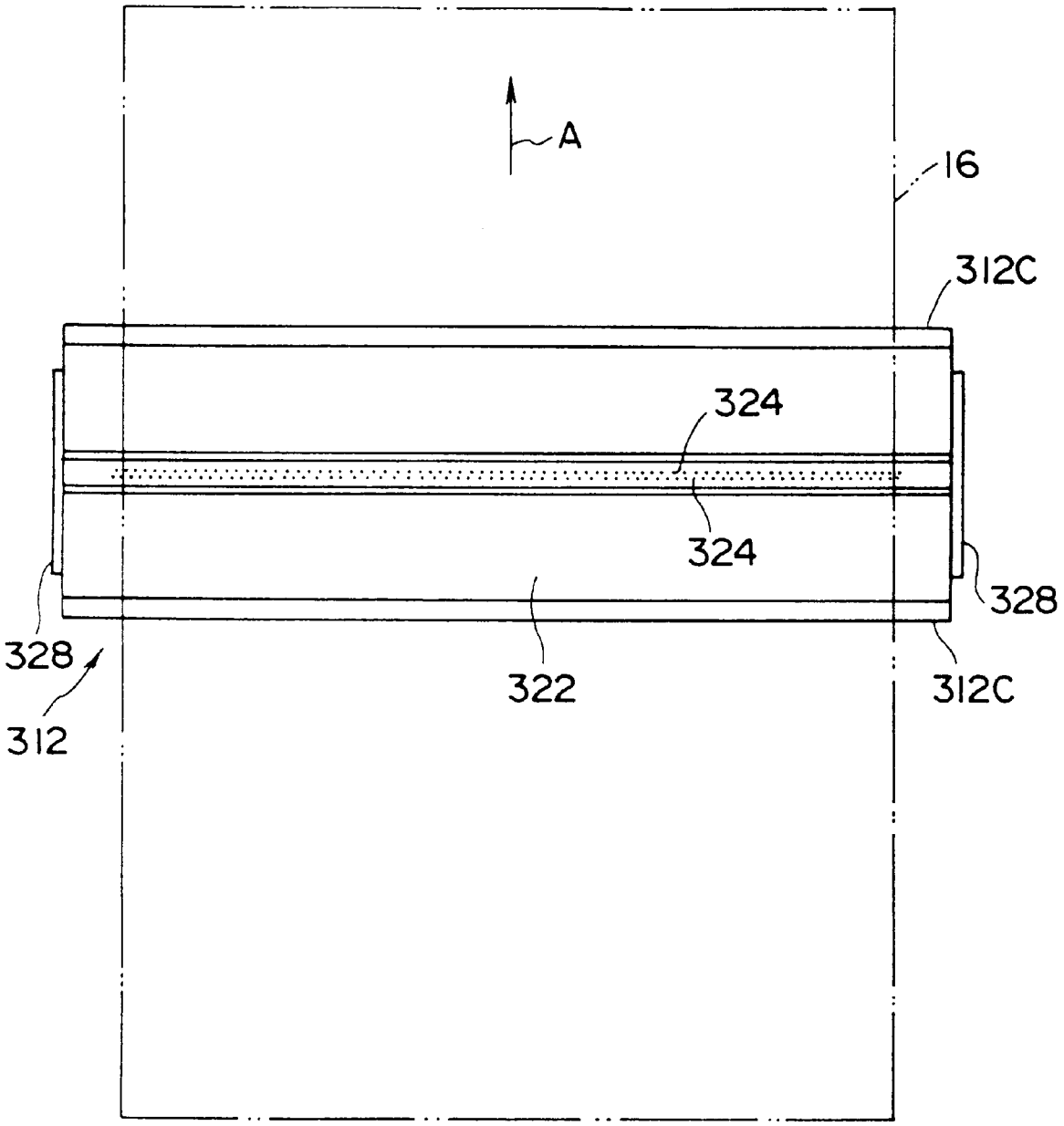
FIG. 4 is a bottom view showing a state in which a light-sensitive material is conveyed under the ejection tank according to the first embodiment of the invention.
Figure 6:
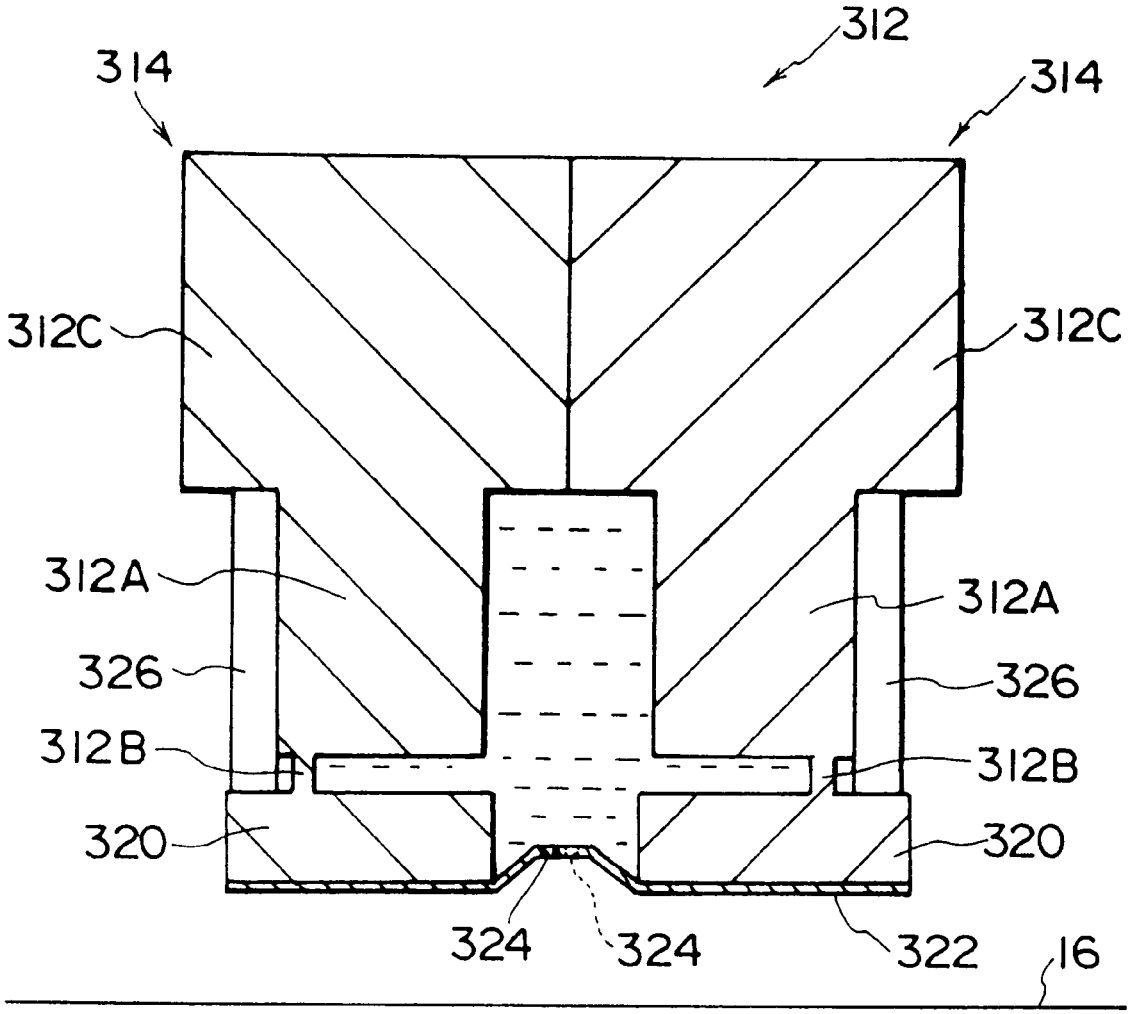
FIG. 6 is a sectional view of the ejection tank according to the first embodiment of the invention.

Further, as shown in FIGS. 4 and 6, a nozzle plate 322 formed by bending an elastically deformable, rectangular, thin plate is provided at a portion of the ejection tank 312 which is a portion of the wall surface of the ejection tank 312 and which opposes the conveying path A of the light-sensitive material 16.

Figure 3:
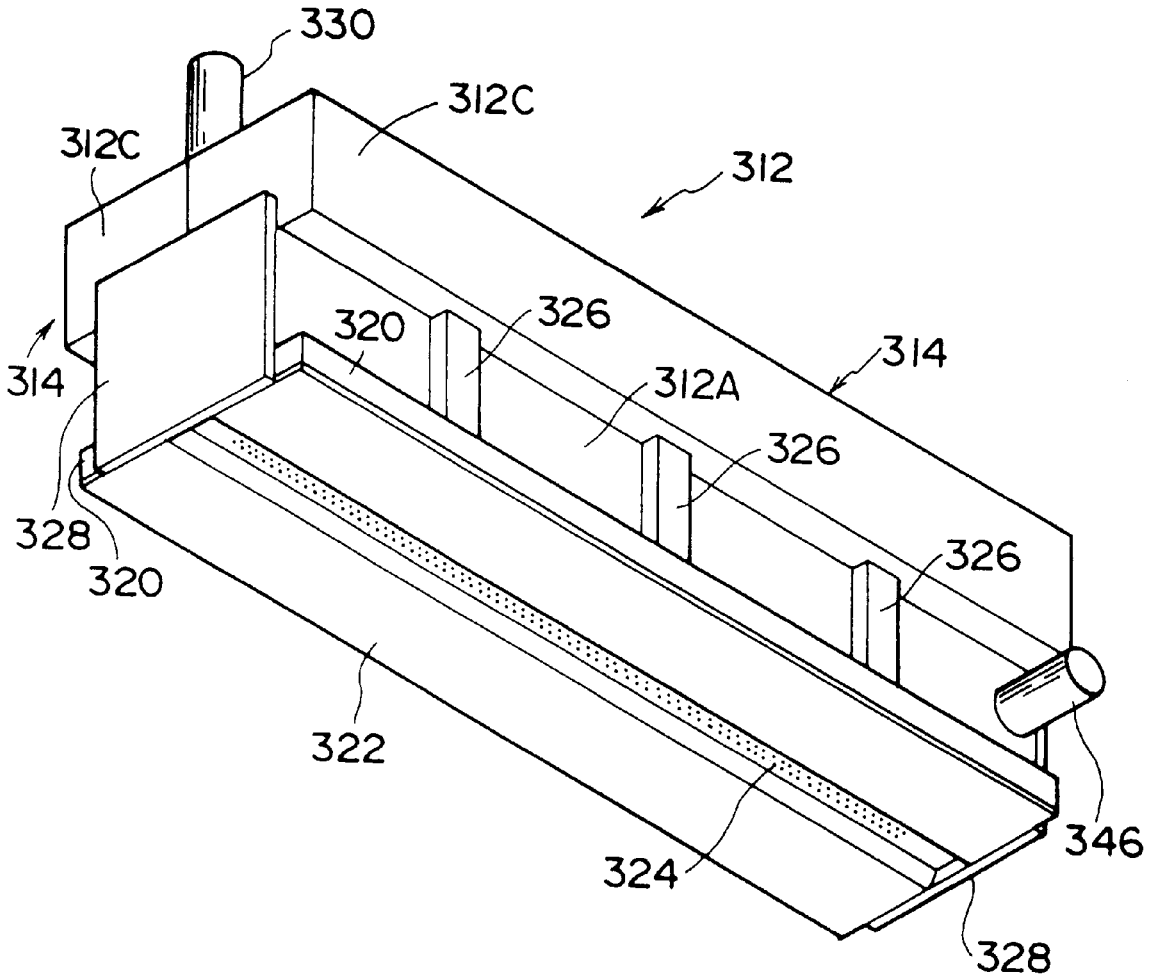
FIG. 3 is an enlarged perspective view showing an ejection tank according to the first embodiment of the invention.
Figure 5:
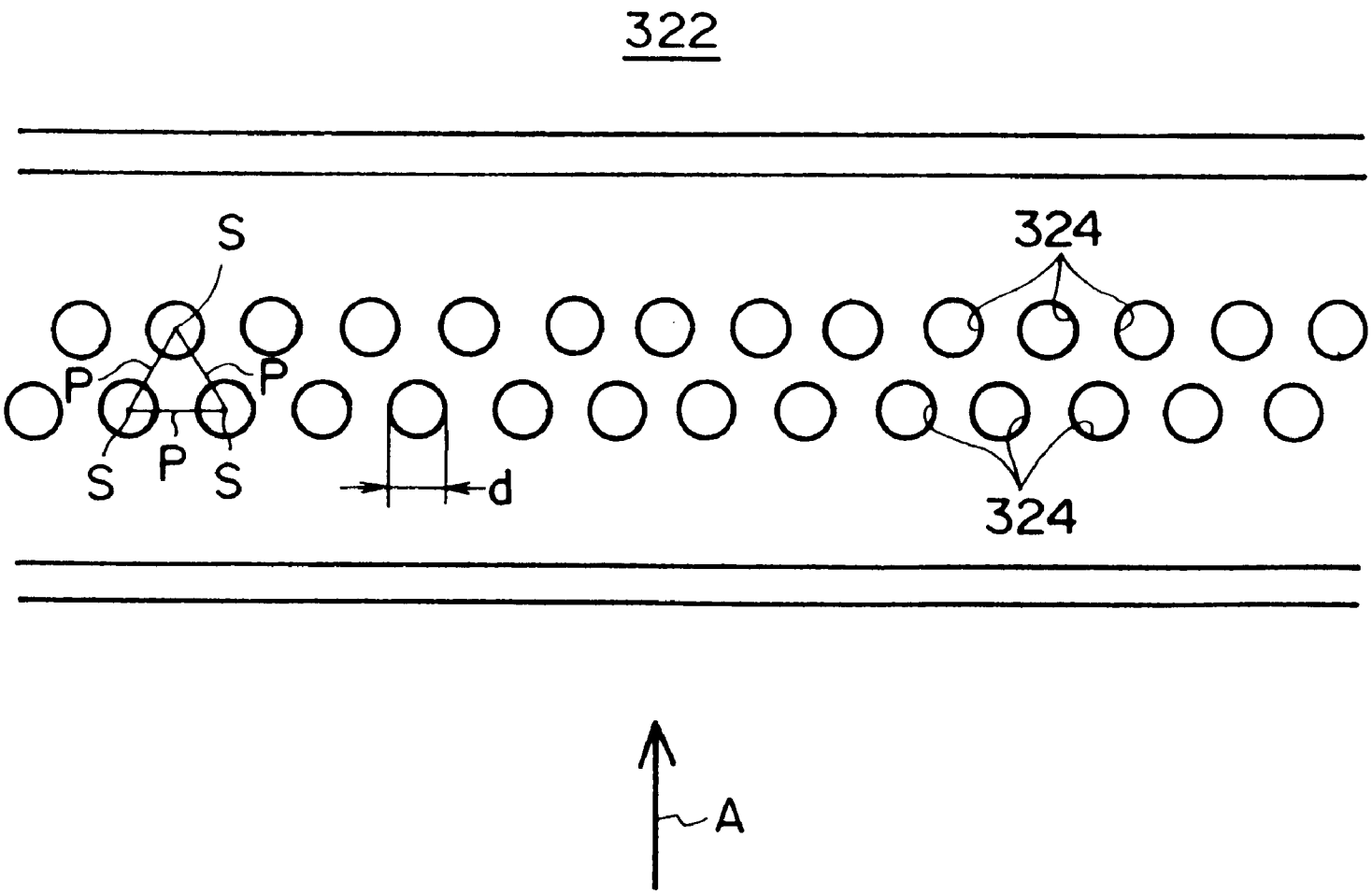
FIG. 5 is an enlarged view of the main portions in FIG. 4.

As shown in FIGS. 3 to 5, the nozzle plate 322 has a plurality of nozzle holes 324 (several tens of $\mu$m in diameter, for example) arranged at regular spatial intervals in two staggered rows over the entire width of the light-sensitive material 16 linearly at an angle to the direction A in which the light-sensitive material 16 is conveyed. The water filled in the ejection tank 312 is released from and ejected toward the light-sensitive material 16 by way of the nozzle holes 324.

As shown in FIG. 5, each of the nozzle holes 324 is formed in a circle having the same inner diameter of d, and therefore, water drops L of substantially the same volume can be ejected from each nozzle hole 324. Further, sets of three adjacent nozzle holes 324 are arranged on the nozzle plate 322 in such a manner that the centers S of the three nozzle holes 324 are the vertices of an equilateral triangle.

As shown in FIGS. 2 and 3, an exhaust pipe 330 extends from the upper portion of the ejection tank 312 so as to provide communication between the outside and inside of the ejection tank 312. Further, a valve (not shown) for opening and closing the exhaust pipe 330 is installed along the route of the exhaust pipe 330. The opening/closing operation of this valve permits the interior of the ejection tank 312 to communicate with or be shut off from the exterior environment.

The end portions of the nozzle plate 322 positioned in the direction orthogonal to the longitudinal direction of the nozzle hole row formed by the plurality of nozzle holes 324 arranged linearly are, as shown in FIG. 6, bonded by an adhesive or the like to a pair of lever plates 320. The nozzle plate 322 is thus adhesively coupled with the pair of lever plates 320. The lever plates 320 are fixed to a pair of side walls 312A of the ejection tank 312, respectively, via narrow support portions 312B formed under the side walls 312A.

A pair of top walls 312C contact each other and form the top side of the ejection tank 312. Portions of these top walls 312C protrude to the outer sides of the ejection tank 312, and a plurality of piezoelectric elements 326 (three on each side in accordance with the present embodiment) serving as actuator means are adhered to the lower sides of the protruding portions of the top walls 312C. The lower surfaces of the piezoelectric elements 326 are bonded to the outer ends of the lever plates 320 so as to be connected to the lever plates 320.

The piezoelectric elements 326, the lever plates 320 and the support portions 312B form a lever mechanism. When the outer side ends of the lever plates 320 are moved by the piezoelectric elements 326, the inner side ends of the lever plates 320 move in the opposite direction. The piezoelectric elements 326 are formed of laminated piezoelectric ceramics, for example, to ensure a greater axial displacement of the piezoelectric elements 326. The piezoelectric elements 326 are connected to a power supply (not shown) to which voltage is applied at a timing controlled by a controller (not shown). The above-described valve for opening and closing the exhaust pipe 330 is also connected to the controller, and the opening and closing operation of the value is controlled by the controller.

The lever plate 320, the side wall 312A, the support portion 312B and the top wall 312C each form a portion of an integrated frame 314. As shown in FIG. 6, a pair of the frames 314 are overlaid and screwed to each other by bolts (not shown). In this way, the outer frame of the ejection tank 312 is made up of a pair of the lever plates 320, a pair of the side walls 312A, a pair of the top walls 312C and a pair of the support portions 312B respectively arranged in opposed relations to each other.

As shown in FIGS. 3 and 4, a thin sealing plate 328 is bonded to the pair of the frames 314 at a position defined by each end pair of the frames 314 and each longitudinal end of the nozzle plate 322.

Further, an elastic adhesive such as silicon rubber, for example, is filled, at the inner sides of the sealing plates 328, to prevent water leakage from the gap defined between the sealing plates 328, the longitudinal ends of the nozzle plate 322, and the longitudinal ends of the frame pair 314. The space in the ejection tank 312 thus is sealed by the elastic adhesive without adversely affecting the movement of the longitudinal ends of the nozzle plate 322. Alternatively, the longitudinal ends of the ejection tank 312 may be sealed only by the elastic adhesive without using the thin sealing plates 328.

Figure 7:
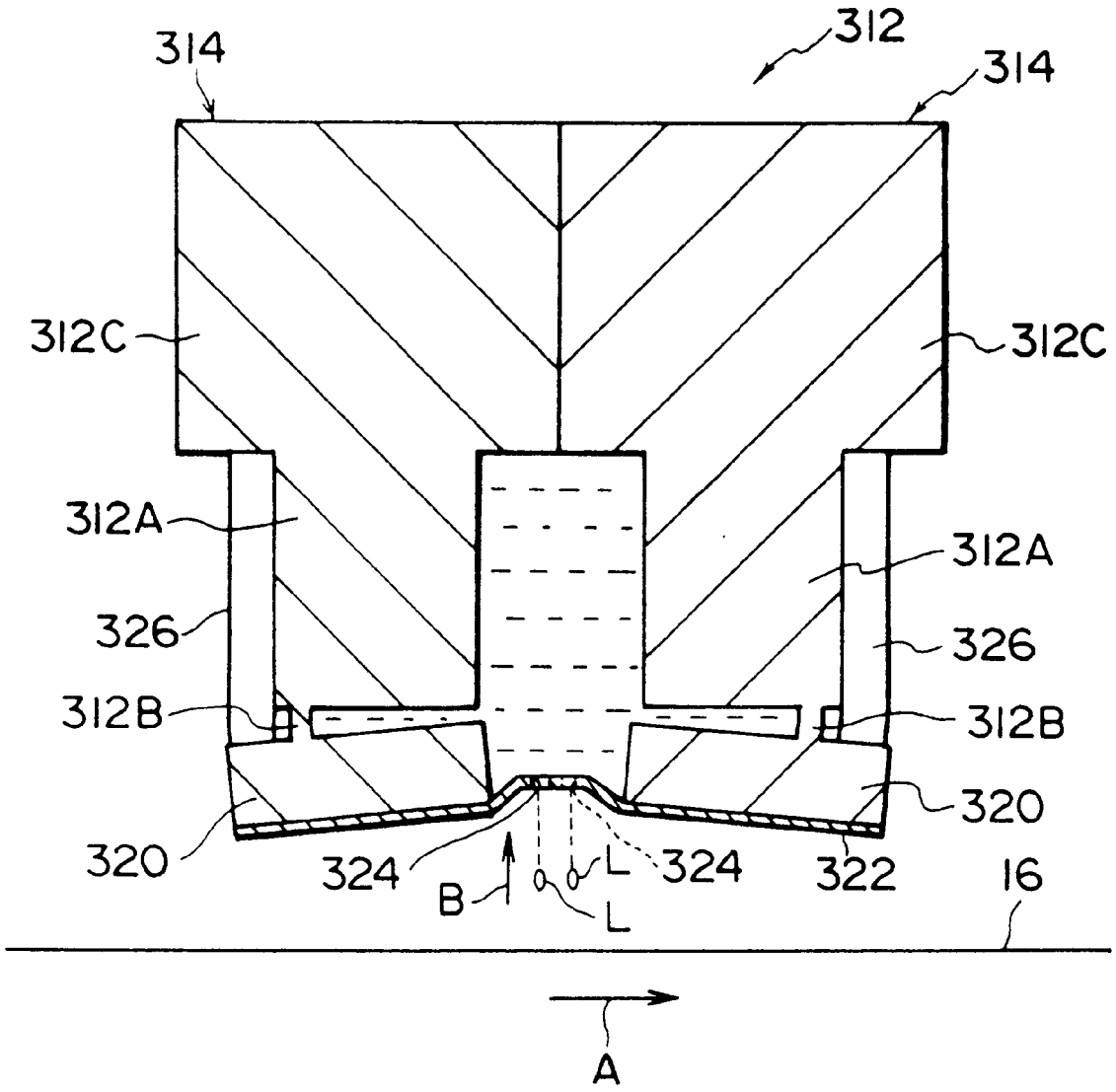
FIG. 7 is a sectional view showing the manner in which water is ejected from the ejection tank according to the first embodiment of the invention.

When power is supplied to the piezoelectric elements 326 from a power supply, as shown in FIG. 7, the piezoelectric elements 326 extend so as to rotate the lever plates 320 around the support portions 312B. Accordingly, the nozzle plate 322 is displaced while being deformed by the piezoelectric elements 326 via the lever plates 320 such that the central portion of the nozzle plate 322 is raised in the direction of arrow B. The deformation of the nozzle plate 322 increases the internal pressure of the ejection tank 312, with the result that water drops L which are a small amount of water are collectively ejected linearly from the nozzle holes 324 which are aligned in two rows.

The water drops L can be continuously ejected from the nozzle holes 324 by supplying power to and extending the piezoelectric elements 326 repeatedly.

Figure 8:
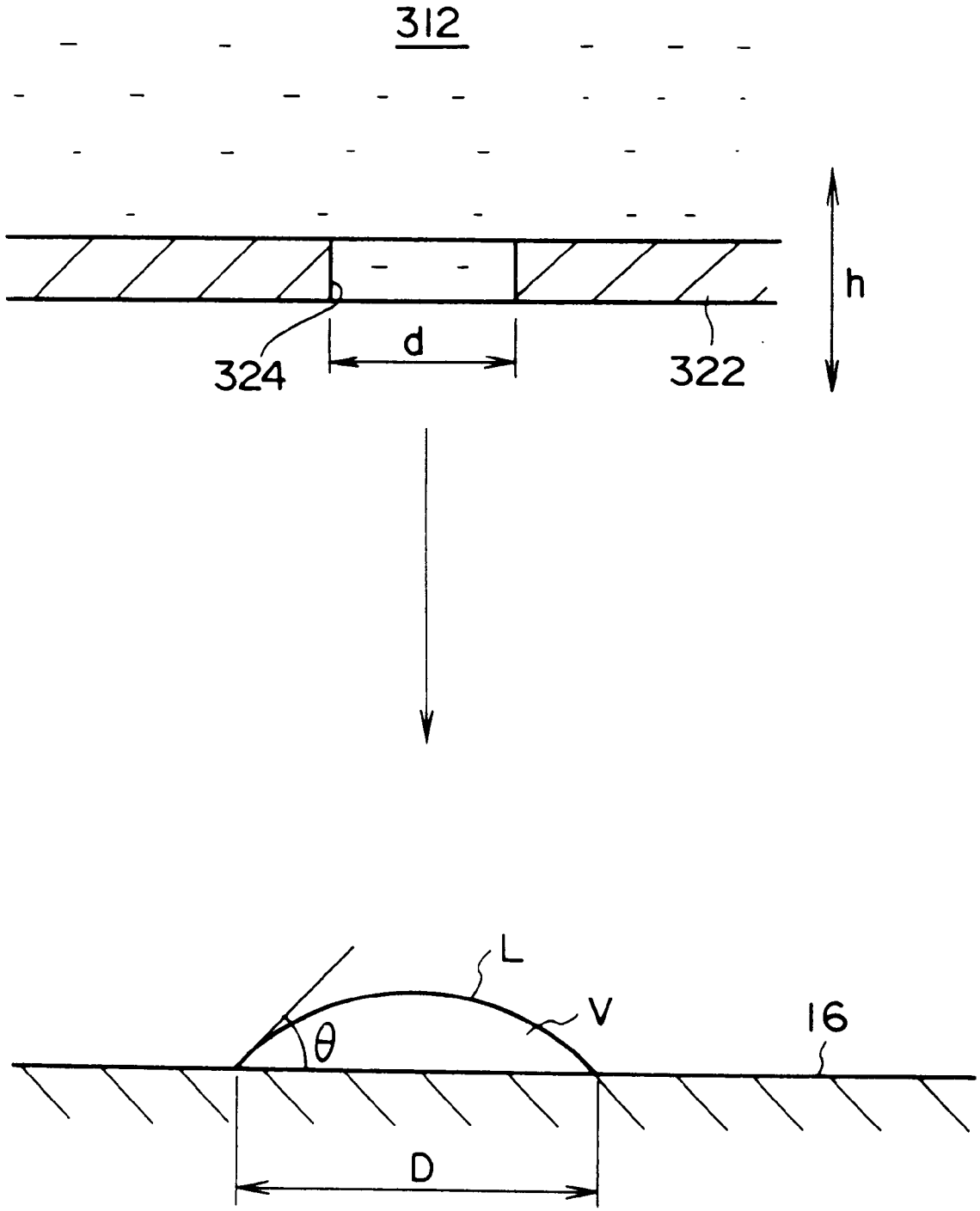
FIG. 8 is a sectional view schematically showing the manner in which a water drop is ejected from a nozzle hole of the ejection tank and adheres to the light-sensitive material according to the first embodiment of the invention.

As shown in FIG. 8, the diameter D of each drop of water L on the light-sensitive material 16 is obtained from the following equation $$D = 2 \cdot \sin\theta \left[ \frac{3 \cdot V}{\pi \cdot \{2 - 3 \cdot \cos\theta + (\cos\theta)^3\}} \right]^{1/3} \quad (1)$$

where V is the volume of each drop of water L ejected from a nozzle hole 324 and θ is the contact angle at which the water drop L adheres to the light-sensitive material 16.

The volume V of a drop of water L can be obtained from Graph 1 below showing the results of an experiment conducted by changing the conditions of the variation width (nozzle amplitude h) at points corresponding to the nozzle holes 324 at the time of displacement of the nozzle plate 322 by the piezoelectric elements 326. In the data employed for this case, the diameter d of the nozzle hole 324 is given as 30 $\mu$m or 80 $\mu$m.

Graph 1

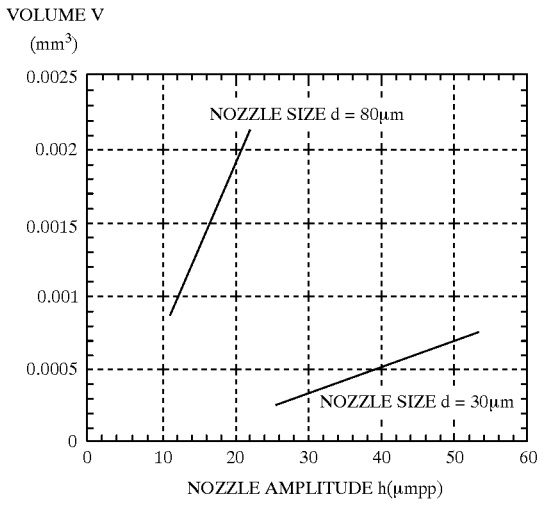

Three water drops L ejected from the nozzle holes 324 adhere to the light-sensitive material 16 adjacent to each other without any space between them.

Figure 11:
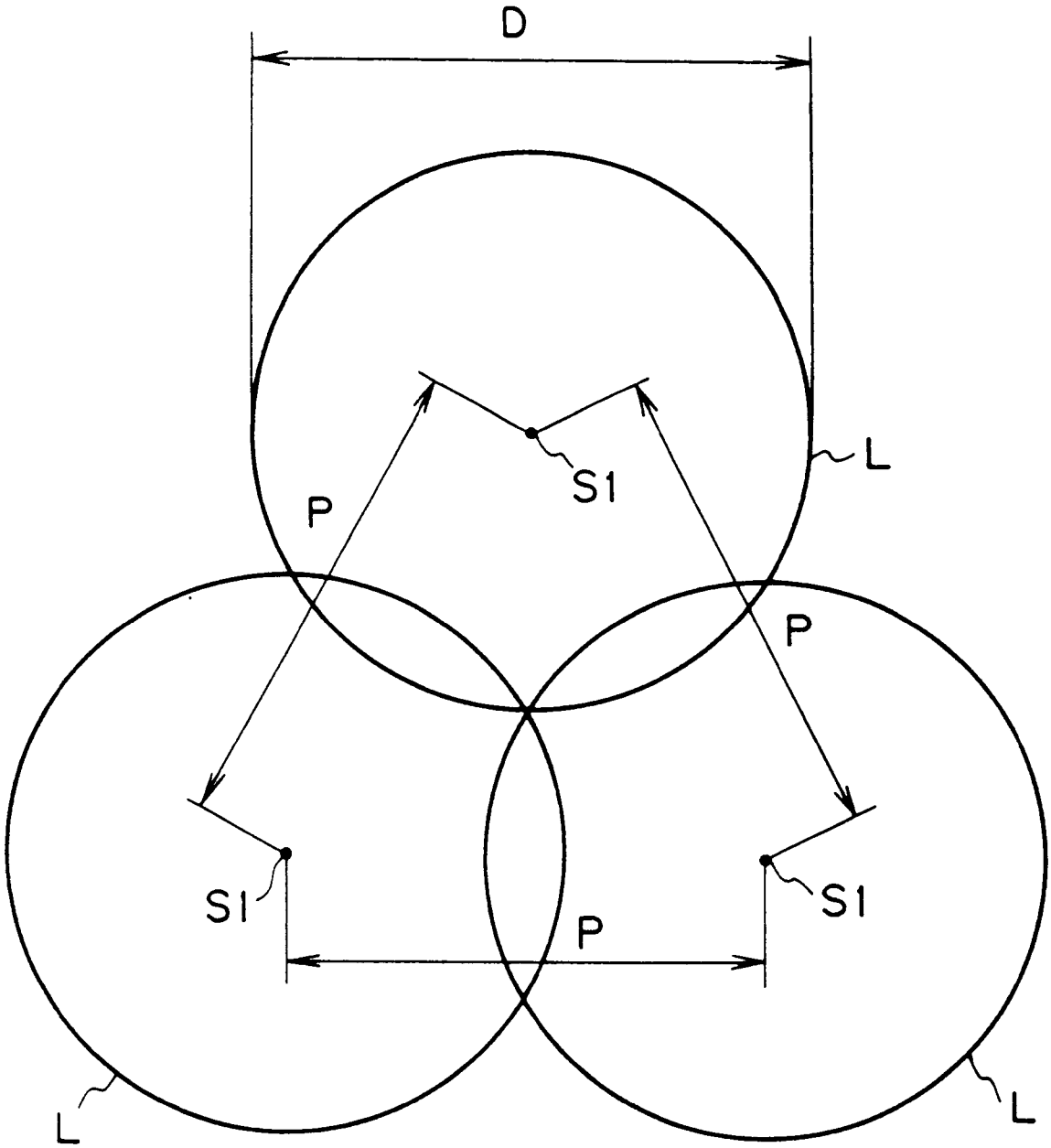
FIG. 11 is an enlarged view schematically showing three water drops out of those which have adhered to the light-sensitive material to which water drops have been ejected and applied from the ejection tank according to the first embodiment of the invention.

In other words, as shown in FIG. 11, the pitch which is the distance between centers S1 of water drops L is equal to the pitch P which is the distance between centers S of adjacent nozzle holes 324. As a result, if the pitch P is a value obtained from the equation given below, the three water drops L adhere to the light-sensitive material 16 closely to each other without any space therebetween.

$$P \leqq \frac{\sqrt{3}}{2} \cdot D \tag{2}$$

Figure 9:
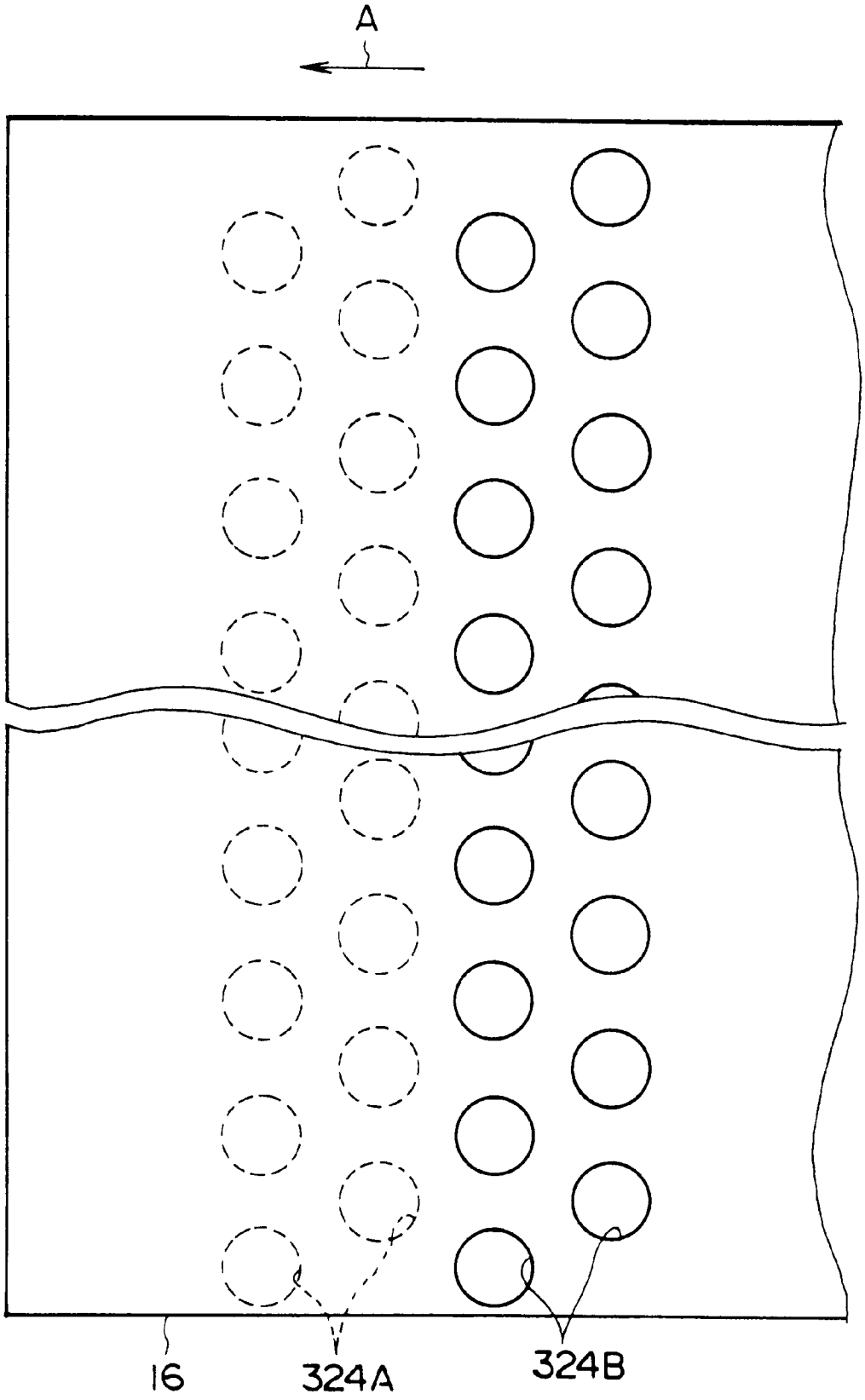
FIG. 9 is a diagram for explaining the positions of the nozzle holes of the ejection tank as projected on the light-sensitive material according to the first embodiment of the invention.
Figure 10:
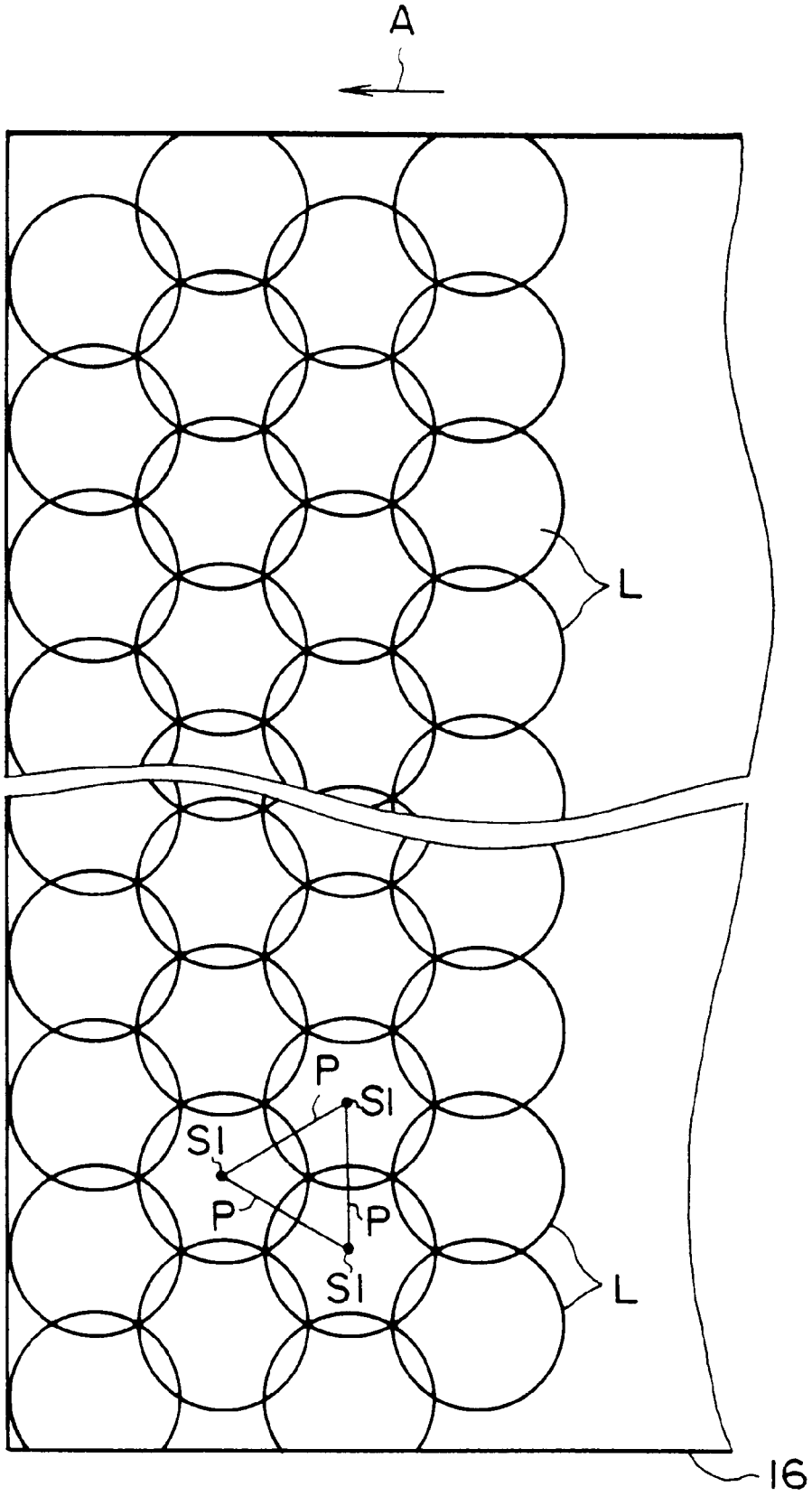
FIG. 10 is a plan view showing the light-sensitive material onto which water drops have been ejected from the nozzle holes of the ejection tank and applied according to the first embodiment of the invention.

Further, water is ejected at a proper timing conforming to the conveying rate of the light-sensitive material 16, i.e., at the moment the nozzle holes 324 are positioned at points above the portions indicated by dotted lines 324A. Then, water drops L are ejected when the nozzle holes 324 are positioned at the point above the portions indicated by solid lines 324B in FIG. 9. As a result, as shown in FIG. 10, water drops L adhere to the surface of the light-sensitive material 16 in such an arrangement that the lines connecting the centers S1 of the water drops L form equilateral triangles.

Actually, however, the water drops L adhered to the surface of the light-material 16 may contact and interfere with each other. In such a case, the water drops L tend to coalesce in an attempt to reduce the surface energy. The water drops L thus overlaid immediately coalesce and are integrated with one another.

As shown in FIG. 1, an image-receiving material magazine 106 for accommodating the image-receiving material 108 is disposed at the upper left corner of the housing 12 in FIG. 1. The image-forming surface of the image-receiving material 108 is coated with a dye-fixing material having a mordant. The image-receiving material 108 is taken up in roll form in the image-receiving material magazine 106 in such a manner that the light-receiving material 108 is withdrawn from the image-receiving material magazine 106 with the image-forming surface thereof facing down.

A pair of nip rollers 110 are disposed in the vicinity of the image-receiving material withdrawal opening of the image-receiving material magazine 106. The nip rollers 110 nip the image-receiving material 108 out of the image-receiving material magazine 106. The nipping of the image-receiving material 108 by the nip rollers 110 can also be cancelled.

A cutter 112 is disposed next to the nip rollers 110. Similarly to the cutter 20 for the light-sensitive material described above, the cutter 112 is a rotary type cutter including a fixed blade and a movable blade, for example. The movable blade of the cutter 112 is moved vertically by a rotary cam or the like into engagement with the fixed blade to thereby cut the image-receiving material 108 withdrawn from the image-receiving material magazine 106 to a length shorter than the light-sensitive material 16.

Conveying rollers 132, 134, 136, 138 and a guide plate (not shown) are disposed next to the cutter 112 so as to convey the image-receiving material 108 which has been cut to predetermined length toward the thermal development-transfer section 120.

Figure 12:
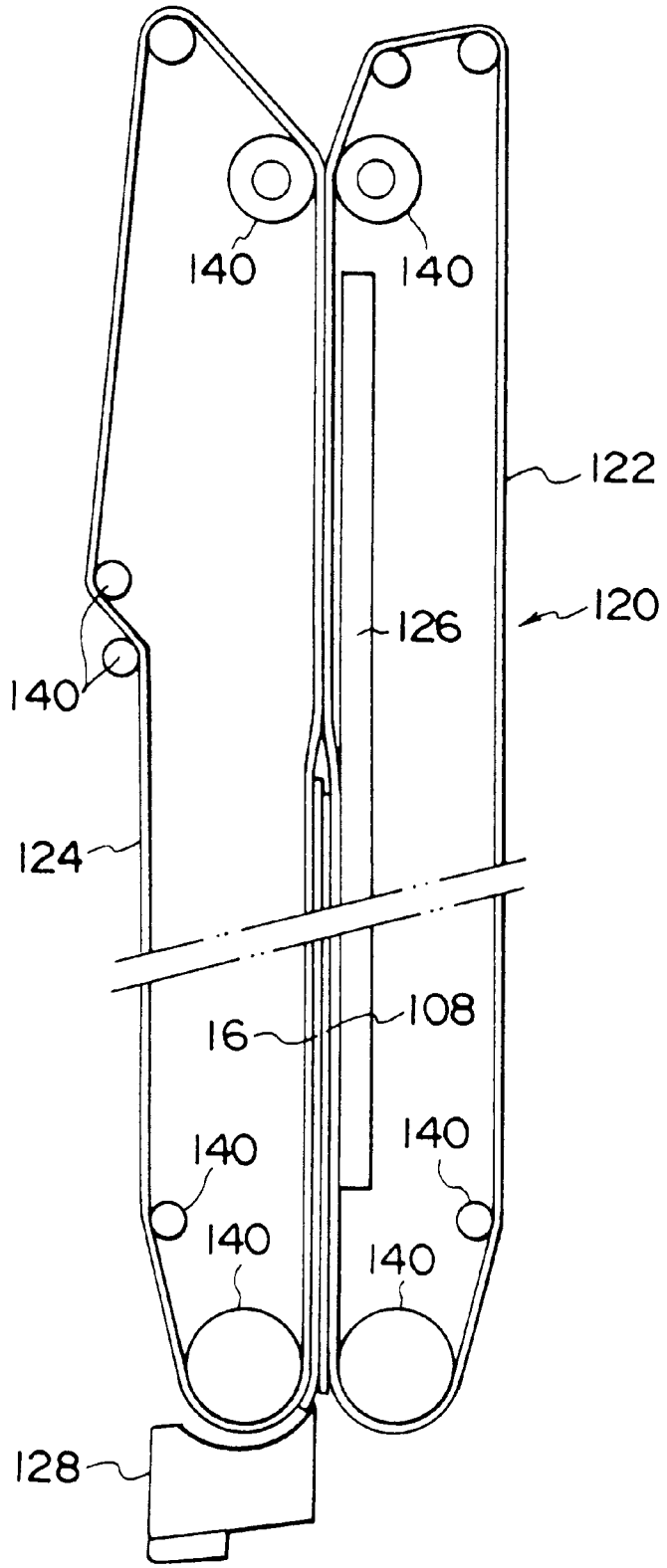
FIG. 12 is an enlarged view of a thermal development-transfer section according to the first embodiment of the invention.

As shown in FIGS. 1 and 12, the thermal development-transfer section 120 includes a pair of endless belts 122, 124 vertically entrained in loops about a plurality of suspension rollers 140. When any one of the suspension rollers 140 is driven to rotate, the endless belts 122, 124 entrained about the suspension rollers 140 begin to rotate.

A flat heating plate 126 is vertically disposed in the loop of the endless belt 122 so as to oppose the inner peripheral surface of the endless belt 122. The heating plate 126 has disposed therein a linear heater (not shown) to heat the surface of the heating plate 126 to a predetermined temperature.

The light-sensitive material 16 is fed between the endless belts 122, 124 of the thermal development-transfer section 120 by the last conveying rollers 34 on the conveying path of the light-sensitive material 16. The image-receiving material 108 is fed synchronously with the light-sensitive material 16. The image-receiving material 108 is, by the last conveying rollers 138 on the conveying path of the image-receiving material 108, fed in between the pair of endless belts 122, 124 and superposed with the light-sensitive material 16, with the light-sensitive material 16 being conveyed a predetermined length ahead of the image-receiving material 108.

The image-receiving material 108 is smaller in both width and length than the light-sensitive material 16. The image-receiving material 108 and the light-sensitive material 16, therefore, are overlaid on each other with the four peripheral sides of the light-sensitive material 16 extending beyond the periphery of the image-receiving material 108.

The light-sensitive material 16 and the image-receiving material 108 overlaid by the endless belts 122, 124 in the manner described above are held and conveyed by the endless belts 122, 124 in this overlaid state. Once the overlaid light-sensitive material 16 and the image-receiving material 108 are completely accommodated between the endless belts 122, 124, the endless belts 122, 124 stop rotating, so that the light-sensitive material 16 and the image-receiving material 108 are heated by the heating plate 126. The light-sensitive material 16 is thus heated through the endless belt 122 and the heating plate 126 both while being conveyed and while in a stationary state. As the heating progresses, the movable dye is released and transferred from the light-sensitive material 16 to the dye fixing layer of the image-receiving material 108 to thereby form an image on the image-receiving material 108.

A separation pawl 128 is disposed downstream of the endless belts 122, 124 in the direction in which the materials are supplied. The separation pawl 128 is adapted to engage with only the leading end portion of the light-sensitive material 16 held and conveyed between the endless belts 122, 124. The leading end portion of the light-sensitive material 16 projecting from between the endless belts 122, 124 can thus be separated from the image-receiving material 108.

Light-sensitive material delivery rollers 148 are disposed to the left (in FIG. 1) of the separation pawl 128. The light-sensitive material 16 guided leftward by the separation pawl 128 can thus be fed further toward a waste light-sensitive material accommodation section 150.

The waste light-sensitive material accommodation section 150 includes a drum 152, on which the light-sensitive material 16 is wound, and a belt 154, a portion of which is entrained around the drum 152. The belt 154, is also entrained about a plurality of rollers 156. Due to the rotation of the rollers 156, the belt 154 is turned thereby to rotate the drum 152. When the light-sensitive material 16 is fed in while the belt 154 is driven by the rotation of the rollers 156, the light-sensitive material 16 can be accumulated around the drum 152.

Image-receiving material delivery rollers 162, 164, 166, 168, 170 are arranged in that order to convey the image-receiving material 103 leftward in FIG. 1 from under the endless belts 122, 124. As a result, the image-receiving material 108 that has been delivered from the endless belts 122, 124 is conveyed by the material delivery rollers 162, 164, 166, 168, 170 into a tray 172.

Operation of the present embodiment will be explained below.

In the image-recording apparatus 10 having the above-described structure, after the light-sensitive material magazine 14 is set in position, the nip rollers 18 are activated so as to withdraw the light-sensitive material 16. As soon as the light-sensitive material 16 is withdrawn by a predetermined length, the cutter 20 is activated to cut the light-sensitive material 16 to a predetermined length, and the cut light-sensitive material 16 is conveyed to the exposure section 22 with the light-sensitive (exposure) surface thereof directed to the left in FIG. 1. While the light-sensitive material 16 is passing through the exposure section 22, the exposure unit 38 is activated so as to scan-expose an image on the light-sensitive material 16 located in the exposure section 22.

When exposure has been completed, the light-sensitive material 16 thus exposed is conveyed to the water application section 50. The water application section 50 delivers the light-sensitive material 16 toward the ejection tank 312 by driving the conveying rollers 32, as shown in FIG. 4.

The ejection tank 312 ejects water and applies the water to the light-sensitive material 16 fed along the conveying path A. The operation and effects at this time will now be explained.

First, the valve of the exhaust pipe 330 is closed by the controller. When water is to be atomized and ejected from the nozzle plate 322 in this state, voltage is applied to the piezoelectric elements 326 from a power supply controlled by the controller, so as to deform all of the piezoelectric elements 326 by extending all of the piezoelectric elements 326 at the same time.

When the piezoelectric elements 326 are deformed in this way, the displacement thereof is transmitted to the nozzle plate 322 via the pair of lever plates 320 rotating around the support portions 312B, so that the nozzle plate 322 is displaced in such a way as to apply pressure to the water in the ejection tank 312. As a result, the water filled in the ejection tank 312 is ejected while being atomized from the nozzle holes 324 as shown in FIG. 7, and can be made to adhere to the light-sensitive material 16 which is being conveyed.

The water can be applied to the entire surface of the light-sensitive material 16 by ejecting the water from the nozzle holes 324 a multiplicity of times at an arbitrary timing conforming with the conveying rate of the light-sensitive material 16.

A plurality of the nozzle holes 324 for ejecting water are arranged in two rows over the entire width of the light-sensitive material 16 in the nozzle plate 322 provided at the ejection tank 312 as a portion of the wall of the ejection tank 312. As described above, the volume V of each of the water drops L ejected from the nozzle holes 324 can be determined from the inner diameter of the nozzle hole 324 and the nozzle amplitude h.

Assuming that the pitch P between the nozzle holes 324 is a value in the range defined by the above equation, each of three water drops L which have adhered to the light-sensitive material 16 adjacent to each other have a diameter D. These water drops L, therefore, adhere to the light-sensitive material 16 so as to contact each other and without any space therebetween.

It is thus possible for the water drops L ejected from the nozzle holes 324 of the ejection tank 312 to adhere to the light-sensitive material 16 uniformly without any space therebetween, on the basis of the relation between the diameter D of the water drop L and the pitch P between adjacent nozzle holes 324. Consequently, a uniform water film (coat) can be formed on the light-sensitive material 16 even in a case in which the light-sensitive material 16 does not contact the ejection tank 312.

In other words, coating irregularities can be eliminated by arranging the nozzle holes 324 in such a manner as to make all of the water drops coalesce so as to form a uniformly-coalesced water film on the light-sensitive material 16 promptly after landing on the light-sensitive material 16.

The water drops L are applied to the light-sensitive material 16 in such a manner that the centers S of the water drops L after landing on the light-sensitive material 16 constitute the vertices of equilateral triangles, respectively, and that the gravitational center of each equilateral triangle is fully covered by the water drops L. In this way, all of the water drops can be made to coalesce with a minimum amount of water.

As described above, a film (coat) of water can be formed uniformly on the light-sensitive material 16 without any deterioration of the image-recording apparatus 10 or the image quality which otherwise might be caused by the contamination of water.

Since the ejection tank 312 has nozzle holes 324 from which water is ejected, a smaller amount of water is required than with an application device which applies water to a light-sensitive material or the like by immersing the light-sensitive material in a tank filled with water. The light-sensitive material 16 thus can be dried in a shorter time.

Furthermore, since the ejection tank 312 has the plurality of nozzle holes 324 arranged over the entire width of the light-sensitive material 16 and water is ejected simultaneously from these nozzle holes 324 by a single displacement of the piezoelectric elements 326, water can be applied over a wide area along the entire width of the light-sensitive material 16 by a single ejection. Consequently, the nozzle plate 322 need not be scanned on a two-dimensional plane, and water application to a larger area in a shorter time is made possible, thereby reducing the overall time required for water application.

Further, the lever plates 320 are coupled to the end portions of the nozzle plate 322 which end portions are at the direction perpendicular to the longitudinal direction of the rows formed by the nozzle holes 324, and the nozzle plate 322 is coupled to the piezoelectric elements 326 through the lever plates 320. As a result, the plurality of nozzle holes 324 can be collectively displaced stably by the same amount of displacement. Water can thus be applied more uniformly to the light-sensitive material 16.

All that is required to manufacture the solvent application device 310 is to form a plurality of the nozzle holes 324 in the nozzle plate 322. Therefore, there is no need for an integration technique, and the solvent application device 310 can be manufactured at a lower cost.

Further, when water is ejected from the nozzle holes 324 of the nozzle plate 322, the amount of water in the ejection tank 312 is progressively reduced. Although the amount of water in the ejection tank 312 is successively reduced, the subtank 338 has the function of keeping the water level in the ejection tank 312 constant by refilling water thereto. Therefore, the water pressure in the ejection tank 312 during atomization operation is kept constant by the water supplied from the subtank 338. Continuous water ejection is thus ensured.

Thereafter, the light-sensitive material 16, to which water serving as an image-forming solvent has been applied by the water application section 50, is fed between the endless belts 122, 124 of the thermal development-transfer section 120 by means of the conveying rollers 34.

As the light-sensitive material 16 is scan-exposed, on the other hand, the image-receiving material 108 is withdrawn and conveyed by the nip rollers 110 from the image-receiving material magazine 108. When the image-receiving material 108 is withdrawn by a predetermined length, the cutter 112 is activated to cut the image-receiving material 108 to a predetermined length.

After the cutting operation of the cutter 112, the image-receiving material 108 thus cut is guided by the guide plate and conveyed by the conveying rollers 132, 134, 136, 138. When the leading end portion of the image-receiving material 108 comes to be held by the conveying rollers 138, the image-receiving material 108 is set in a standby state directly before the thermal development-transfer section 120.

As the light-sensitive material 16 is fed between the endless belts 122, 124 by the conveying rollers 34 as described above, the image-receiving material 108 begins to be conveyed again. The image-receiving material 108 thus is fed integrally with the light-sensitive material 16 between the endless belts 122, 124.

As a result, the light-sensitive material 16 and the image-receiving material 108 are superposed on each other, and while being heated by the heating plate 126, are held and conveyed so that an image is formed on the image-receiving material 108 by thermal development and transfer.

Further, after the light-sensitive material 16 and the image-receiving material 108 are delivered from the endless belts 122, 124, the leading end portion of the light-sensitive material 16, which precedes the image-receiving material 108 by a predetermined length, engages with the separation pawl 128 so as to be separated from the image-receiving material 108. The light-sensitive material 16 is further conveyed by the light-sensitive material delivery rollers 148 so as to be fed into and accumulated in the waste light-sensitive material accommodation section 150. At this time, the light-sensitive material 16 is dried very quickly, and therefore no heater or the like is required to dry the light-sensitive material 16.

On the other hand, the image-receiving material 108 that has been separated from the light-sensitive material 16, is conveyed by the image-receiving material delivery rollers 162, 164, 166, 168, 170 and delivered into the tray 172.

In the case of recording a plurality of image frames, the above-mentioned processes are repeated successively.

The image-receiving material 108 on which a predetermined image has been formed (recorded) by thermal development and transfer between the endless belts 122, 124 is delivered out from the endless belts 122, 124. The image-receiving material 108 thus delivered is discharged to the exterior of the apparatus by being held and conveyed by the plurality of image-receiving material delivery rollers 162, 164, 166, 168, 170.

Figure 13:
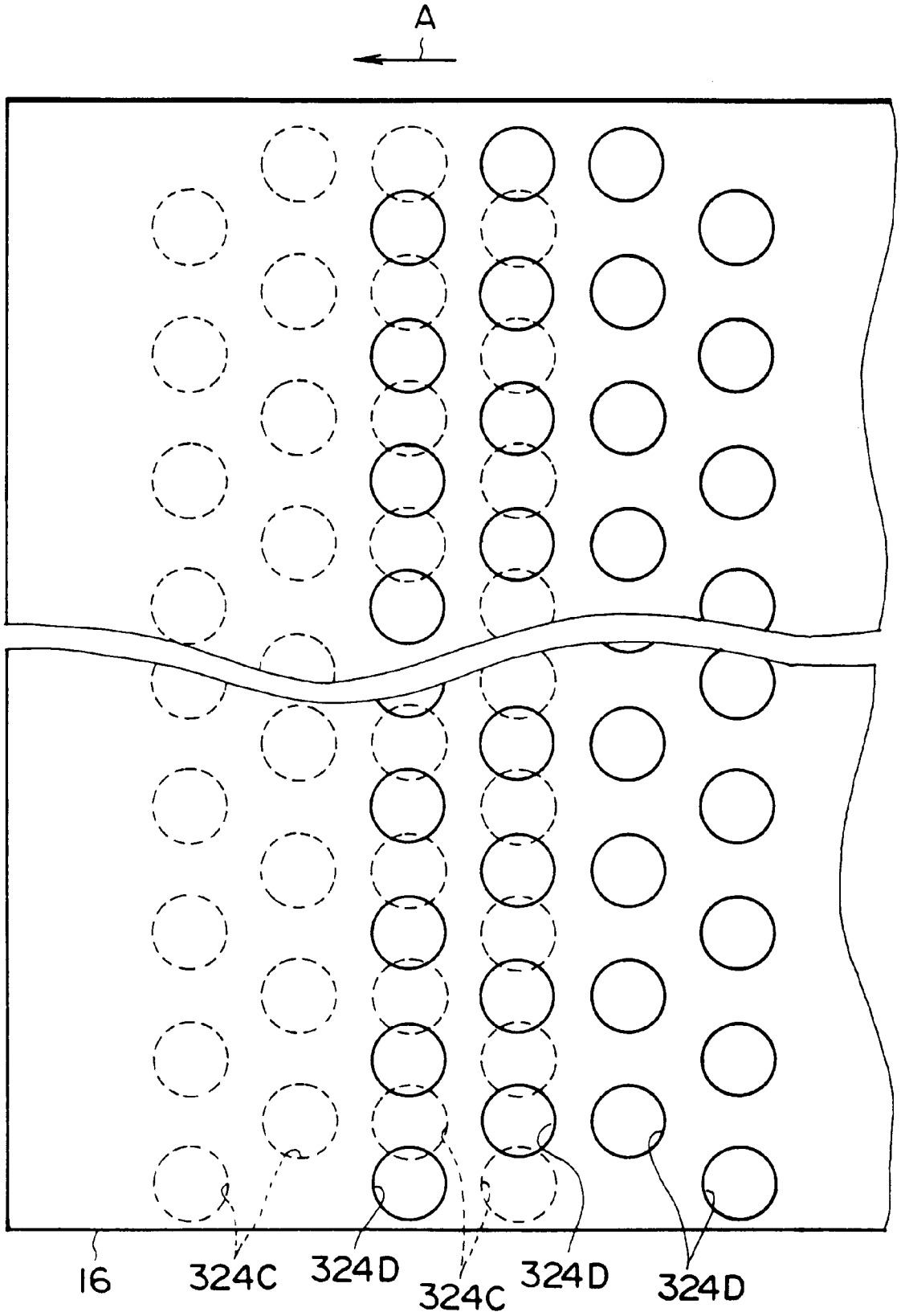
FIG. 13 is a diagram for explaining the positions of the nozzle holes of the ejection tank as projected on the light-sensitive material according to a second embodiment of the invention.

The positions of the nozzle holes 324 of the ejection tank 312 relating to the second embodiment of the present invention, which positions are projected onto the light-sensitive material 16, are illustrated in FIG. 13 and described hereinafter. The same component parts as those described in the first embodiment are designated by the same reference numerals respectively, and will not be described again.

As shown in FIG. 13, the nozzle plate 322 of the ejection tank 312 according to the present second embodiment is formed with a plurality of the linearly-aligned, water-ejecting nozzle holes 324 in a staggered fashion at regular spatial intervals in two rows at an angle to the direction A in which the light-sensitive material 16 is conveyed.

More specifically, the nozzle holes 324 are arranged in four rows and water drops L are repeatedly ejected at a timing shown by dotted lines 324C and solid lines 324D. This not only has the same effects as the first embodiment but also can improve the redundancy of atomization accompanying the ejection.

In other words, should any one of the nozzle holes 324 be clogged, other nozzle holes 324 can compensate for the clogging, and therefore no coalescence irregularities occur.

According to the first embodiment, the nozzle holes 324 are arranged in two rows at positions such that the lines connecting the centers S of a given set of three nozzle holes 324 form an equilateral triangle. The two nozzle hole rows, however, are not necessarily disposed at positions at which the lines connecting the centers S of a given set of three nozzle holes form an equilateral triangle. Instead, the two rows may be disposed at a distance from each other. Further, more than two rows of nozzle holes may be used. The actuator means can be driven a lesser number of times by increasing the number of nozzle hole rows.

The relation between the pitch P and the diameter D of the water drops L was explained by the critical value above. Actually, however, allowing for irregularities in the direction in which the water drops L fly and the tolerance in diameters of the water drops L, the nozzle holes 324 can be arranged more closely (densely) than in the above-described embodiments to ensure that all of the water drops coalesce when the water drops L having a minimum diameter fly in the most irregular directions.

The volume V of the water drop L in the first and second embodiments described above may be in the range of 0.00001 to 0.01 $mm^3$, the contact angle $\theta$ may be 40 degrees or less, and the thickness of the water film formed on the light-sensitive material 16 may be in the range of 1 to 100 $\mu$m. The invention, however, is not limited to these values.

Further, each nozzle hole row may be arranged in a direction other than a direction perpendicular to the direction in which the material is conveyed, unlike in the above-described embodiments. For example, the nozzle holes may be arranged diagonally to the direction in which the material is conveyed.

In the above-described embodiments, the light-sensitive material 16 and the image-receiving material 108 are used as image-recording materials, water is applied by means of the ejection tank 312 of the solvent application device 310 to the light-sensitive material 16 after exposure thereof, the light-sensitive material 16 and the image-receiving material 108 are superposed, and thermal development and transfer are carried out. However, the present invention is not limited to the same, and water may be ejected toward and applied to the image-receiving material 108.

Furthermore, another image-recording material in sheet or roll form may be used in place of the above-mentioned materials. Moreover, a solvent other than water may be used as the image-forming solvent. The present invention is applicable also to the application of a developer onto a photographic printing paper in a developing device, the application of water in a printing press, the coating machine, and the like.

It can thus be understood from the foregoing description that the image-forming apparatus according to the present invention has the great advantage that a uniform film can be coated on an image-recording material.

What is claimed is:

1. An image-forming apparatus comprising an application device for applying an image-forming solvent onto an image-recording material, wherein said application device includes lever plates, piezoelectric elements, and a nozzle plate having a plurality of nozzle holes formed therein for ejecting and applying drops of the image-forming solvent uniformly onto an entire surface of the image recording material, the nozzle plate including end portions coupled to the piezoelectric elements through the lever plates, and said application device applies the image-forming solvent, which is ejected from said plurality of nozzle holes and applied onto the image recording material, such that any of sets of three drops of the image-forming solvent ejected from any of sets of three adjacent nozzle holes arranged to form substantially equilateral triangles, are applied onto the image-recording material to contact each other without any space therebetween using a minimum quantity of image-forming solvent.

2. An image-forming apparatus comprising an application device for applying an image-forming solvent onto an image-recording material, wherein said application device includes lever plates, piezoelectric elements, and a nozzle plate having a plurality of nozzle holes formed therein for ejecting and applying drops of the image-forming solvent uniformly onto an entire surface of the image recording material, the nozzle plate including end portions coupled to the piezoelectric elements through the lever plates, and said application device applies the image-forming solvent, which is ejected from said plurality of nozzle holes and applied onto the image recording material, wherein said plurality of nozzle holes are arranged so that sets of three adjacent nozzles holes form equilateral triangles, and sets of drops of image forming solvent ejected from the set of three adjacent nozzle holes are applied onto the image recording material in an equilateral triangle pattern so that the drops contact each other without any space therebetween using a minimum quantity of image-forming solvent.

3. An image-forming apparatus according to claim 1, wherein said nozzle holes are aligned in a plurality of linear parallel rows.

4. An image-forming apparatus according to claim 1, wherein said nozzle holes are aligned in two linear parallel rows.

5. An image-forming apparatus according to claim 1, wherein said nozzle holes are aligned in four linear parallel rows.

6. An image-forming apparatus according to claim 1, wherein the image-recording material is a light-sensitive material exposed by a light beam.

7. An image-forming apparatus according to claim 1, wherein the image-forming solvent is water.

8. An image-forming apparatus according to claim 1, wherein said application device includes a plurality of nozzle holes for ejecting and uniformly applying a plurality of drops the image-forming solvent to adhere onto an entire surface of said image recording material, wherein a diameter of D of each drop of the plurality of drops of the image-forming solvent adhering to the image-recording material is expressed as $$D=2\sin\theta[3\cdot V/7\pi\{2-3\cdot\cos\theta+(\cos\theta)^3\}]^{+hu\ 1/3} \quad (1)$$

wherein V is a volume of one of the plurality of drops of the image-forming solvent ejected from a nozzle hole and θ is a contact angle at which one of the plurality of drops of the image-forming solvent adheres to the image-recording material, and a pitch P between adjacent nozzle holes of said application device is less than or equal to $(\sqrt{3})\cdot D/2$; and wherein a minimum quantity of image-forming solvent is used.

9. An image-forming apparatus according to claim 8, wherein the volume V is in the range of 0.00001 to 0.01 $mm^3$.

10. An image-forming apparatus according to claim 8, wherein the contact angle θ is less than or equal to 40 degrees.

11. An image-forming apparatus according to claim 8, wherein said nozzle holes are aligned in a plurality of linear parallel rows.

12. An image-forming apparatus according to claim 8, wherein said nozzle holes are aligned in two linear parallel rows.

13. An image-forming apparatus according to claim 8, wherein the image-recording material is a light-sensitive material exposed by a light beam.

14. An image-forming apparatus according to claim 1, wherein said application device comprises:

an ejection tank for storing the image-forming solvent, and wherein said nozzle plate forms a portion of a wall surface of said ejection tank.

15. An image-forming apparatus according to claim 14, wherein said nozzle plate is disposed at a surface of said ejection tank which surface opposes the image-recording material, and the image-forming solvent is ejected to the image-recording material from said ejection tank by said nozzle plate being displaced by said lever mechanism.

16. An image-forming apparatus according to claim 14, wherein said lever mechanism has at least one piezoelectric element which is an actuating means, and said image-forming solvent is ejected from said ejection tank by said nozzle plate being displaced by said lever mechanism due to activation of said at least one piezoelectric element.

17. An image-forming apparatus according to claim 14, wherein said nozzle holes are aligned in a plurality of linear parallel rows.

18. An image-forming apparatus according to claim 14, wherein said nozzle holes are aligned in two linear parallel rows.

19. An image-forming apparatus according to claim 14, wherein the image-recording material is a light-sensitive material exposed by a light beam.

20. An image-forming apparatus for use with light sensitive material, image-forming solvent, and image receiving material, the apparatus comprising:

a light-sensitive material magazine for dispensing light-sensitive material therefrom onto a path of conveyance followed b the light sensitive material;

an exposure section disposed downstream along the path of conveyance from said light-sensitive material magazine, for exposing the light-sensitive material to image-forming light after said light-sensitive material leaves the light-sensitive material magazine;

application means for applying an image-forming solvent disposed downstream from said exposure section onto the exposed light-sensitive material, said application means including lever plates, piezoelectric elements, and a nozzle plate having a plurality of nozzle holes formed therein for ejecting and applying drops of image-forming solvent uniformly onto an entire surface of the exposed light-sensitive material, the nozzle plate including end portions coupled to the piezoelectric elements through the lever plates;

wherein said plurality of nozzle holes are arranged so that sets of three adjacent nozzles holes form equilateral triangles, and sets of drops of image forming solvent ejected from the set of three adjacent nozzle holes are applied onto the light-sensitive material in an equilateral triangle pattern so that the drops contact each other without any space therebetween using a minimum quantity of image-forming solvent;

an image-receiving material magazine disposed upstream from said application means for dispensing therefrom image receiving material; and a thermal development transfer section disposed downstream from said application means, wherein exposed light-light sensitive material, after image-forming solvent is applied by the application means, and the image-receiving material, are overlaid and conveyed through the thermal development transfer section synchronously, and then heated, such that an image is formed on the image-receiving material.

21. An image-forming apparatus comprising an application device for applying an image forming solvent onto an image-recording material, wherein said application device includes lever plates, piezoelectric elements, and a nozzle plate having a plurality of nozzle holes formed therein for ejecting and applying drops of the image-forming solvent uniformly onto an entire surface of the image recording material, the nozzle plate including end portions coupled to the piezoelectric elements through the lever plates, and said application device applies the image-forming solvent, which is ejected from said plurality of nozzle holes and applied onto the image recording material, wherein said plurality of nozzle holes are arranged so that sets of three adjacent nozzles holes form the vertices of equilateral triangles, and sets of drops of image forming solvent ejected from the set of three adjacent nozzle holes are applied onto the image recording material in an equilateral triangle pattern so that the drops contact each other without any space therebetween using a minimum quantity of image-forming solvent.

* * * * *